US007438431B2

(12) United States Patent
Ford et al.

(10) Patent No.: US 7,438,431 B2
(45) Date of Patent: Oct. 21, 2008

(54) PORTABLE LIGHT WITH CLIP

(75) Inventors: Timothy D. F. Ford, Beaconsfield (CA); Stephane Gascon, Mascouche (CA)

(73) Assignee: The Flewelling Ford Family Trust, Beaconsfield (CA)

( * ) Notice: Subject to any disclaimer, the term of this patent is extended or adjusted under 35 U.S.C. 154(b) by 117 days.

(21) Appl. No.: 11/567,675

(22) Filed: Dec. 6, 2006

(65) Prior Publication Data

US 2007/0139917 A1 Jun. 21, 2007

Related U.S. Application Data

(60) Provisional application No. 60/742,563, filed on Dec. 6, 2005.

(51) Int. Cl.
*F21V 33/00* (2006.01)

(52) U.S. Cl. ..... 362/116; 362/200; 362/208

(58) Field of Classification Search ..... 362/109, 362/116, 184, 190, 191, 196, 200, 208, 396, 362/800; 70/456 B, 456 R, 459; 24/3.6, 24/3.11, 3.12; D26/37, 38, 39, 46, 49, 50
See application file for complete search history.

(56) References Cited

U.S. PATENT DOCUMENTS 2,591,419 A * 4/1952 Gheorhiu ..... 362/200
D289,931 S * 5/1987 Grae ..... D26/50
4,692,846 A 9/1987 Johnson
D351,479 S 10/1994 Meyer
6,190,018 B1 2/2001 Parsons et al.
6,299,323 B1 10/2001 Yu et al.
6,550,930 B1 * 4/2003 Portouche ..... 362/109
6,591,646 B1 * 7/2003 Huang ..... 362/116
6,637,910 B1 10/2003 Mehler et al.
6,685,338 B1 * 2/2004 Lewis et al. ..... 362/800
D495,075 S * 8/2004 Oas ..... D26/37
D498,864 S 11/2004 Lee
7,048,407 B2 5/2006 Kumthampinij et al.
D542,453 S * 5/2007 Osiecki et al. ..... D26/37
2004/0201983 A1 10/2004 Yu

* cited by examiner

*Primary Examiner*—Y My Quach Lee
(74) *Attorney, Agent, or Firm*—Goudreau Gage Dubuc

(57) ABSTRACT

A portable light is disclosed comprising at least one light emitting diode, a power source, a switch operable for closing an electronic circuit between the power source and the light emitting diode, wherein when the electronic circuit is closed the at least one diode emits light generally about a first axis, and a body adapted to receive the light emitting diode, the battery and the switch, the body comprising a loop portion towards one end thereof defining a loop aperture having an axis which is substantially parallel to the first axis.

4 Claims, 3 Drawing Sheets

PORTABLE LIGHT WITH CLIP

CROSS REFERENCE TO RELATED APPLICATIONS

The present application claims priority from U.S. Provisional Application No. 60/742,563 filed on Dec. 6, 2005 the entirety of which is incorporated herein by reference

FIELD OF THE INVENTION

The present invention relates to a portable light with clip. In particular, the present invention relates to a portable light comprising a karabiner like loop at one end.

BACKGROUND TO THE INVENTION

The prior art reveals a variety of light emitting devices in combination with loops and clips for attachment to other objects. Examples of such prior art devices include small flashlights integrated into key chains and pendants, amongst others. One drawback of such prior art devices is that the light source is typically oriented with respect to the loop or the clip such that when the light source is suspended by the clip under its own weight, the light source is directed vertically downward.

SUMMARY OF THE INVENTION

In order to address the above and other drawbacks, there is disclosed a portable light comprising at least one light emitting diode, a power source, a switch operable for closing an electronic circuit between the power source and the light emitting diode, wherein when the electronic circuit is closed the at least one diode emits light generally about a first axis, and a body adapted to receive the light emitting diode, the battery and the switch, the body comprising a loop portion towards one end thereof defining a loop aperture having an axis which is substantially parallel to the first axis.

DETAILED DESCRIPTION OF THE ILLUSTRATIVE EMBODIMENTS

Figure 1:
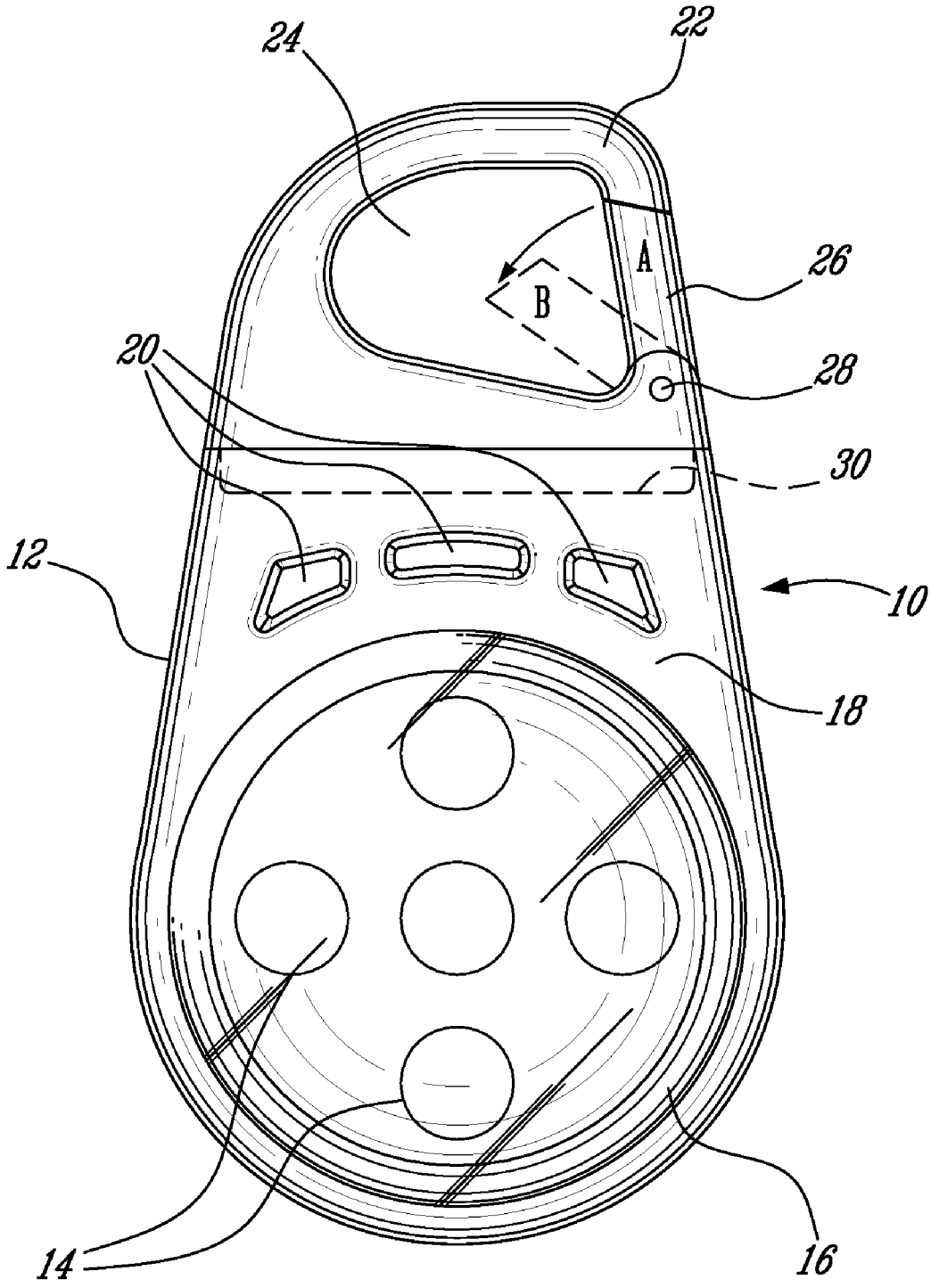
FIG. 1 is a front plan view of a portable light with clip in accordance with an illustrative embodiment of the present invention.

Referring now to FIG. 1, a portable light with clip, generally referred to using the reference numeral 10, will now be described. The portable light 10 is comprised of a hollow body 12 manufactured from a durable material such as plastic or cast metal which houses a series of light sources as in 14, such as LEDs or the like. The light sources may produce white light, light in a variety of different colours or emit light in the infra-red range. The light sources as in 14 are encased in a transparent lens 16 which is securely mounted to an upper surface 18 of the hollow body 12. A series of buttons (switches) as in 20 are also mounted on the upper surface 18 of the hollow body 12 allowing a user to access functions supported by electronics (not shown) encapsulated within the hollow body 12.

Figure 2:
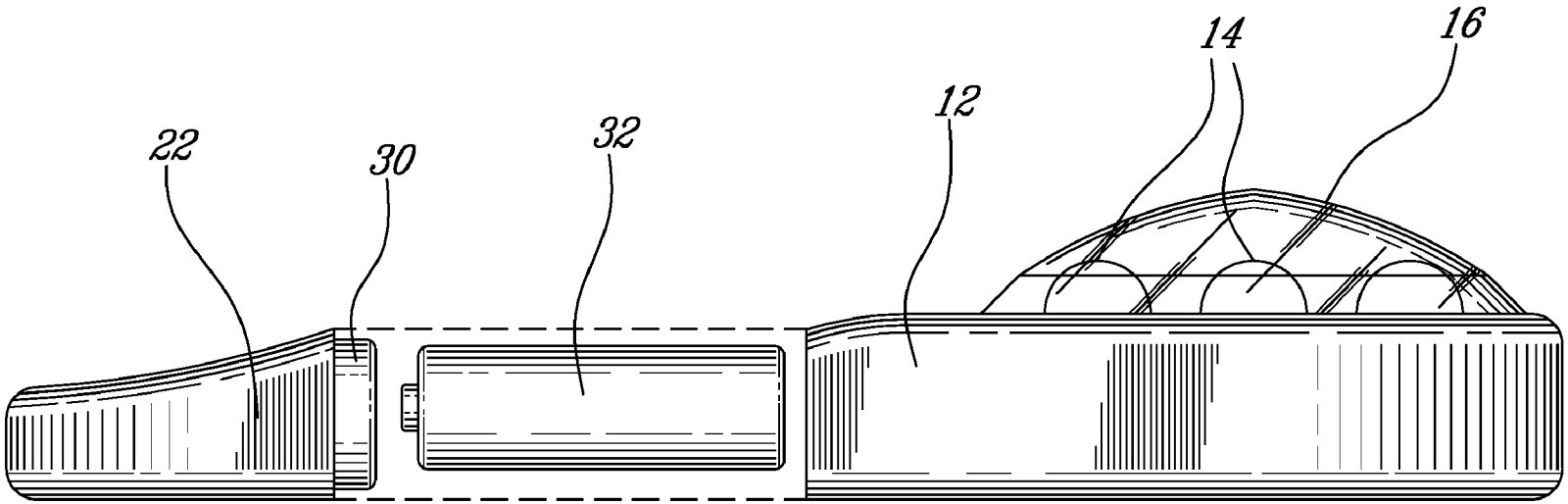
FIG. 2 is an exploded side view of a portable light with clip in accordance with an illustrative embodiment of the present invention.

Still referring to FIG. 1, a loop comprised of a karabiner like hook portion 22 is mounted towards one end of the hollow body 12 and defines a loop aperture 24. The hook portion 22 also comprises a spring loaded clip 26 moveable between a normally closed position A and an open position B around a pivot 28. Illustratively, the hook portion 22 comprises a flange 30 which fits snugly yet releasably within the hollow body 12, thereby allowing the hook portion 22 to be removed from the hollow body 12. Referring now to FIG. 2, once the hook portion 22 is removed, the interior of the hollow body 12 can be accessed thereby allowing, for example, batteries as in 32 for powering the light sources 14 to be inserted and removed. This configuration also provides a means during manufacture for inserting electronics into the hollow body 12 which can then be, if required, potted with a suitable potting material in order to improve the resilience of the portable light 10 to moisture and impact.

Note that, in an alternative embodiment the hollow body 12 and the hook portion 22 could be moulded or bonded together. In this alternative embodiment, provision would be made in the lower surface of the hollow body, by way of a removable cover or the like (not shown), in order to access the interior of the hollow body 12 for inserting batteries as in 32 for powering the light sources 14.

Figure 3:
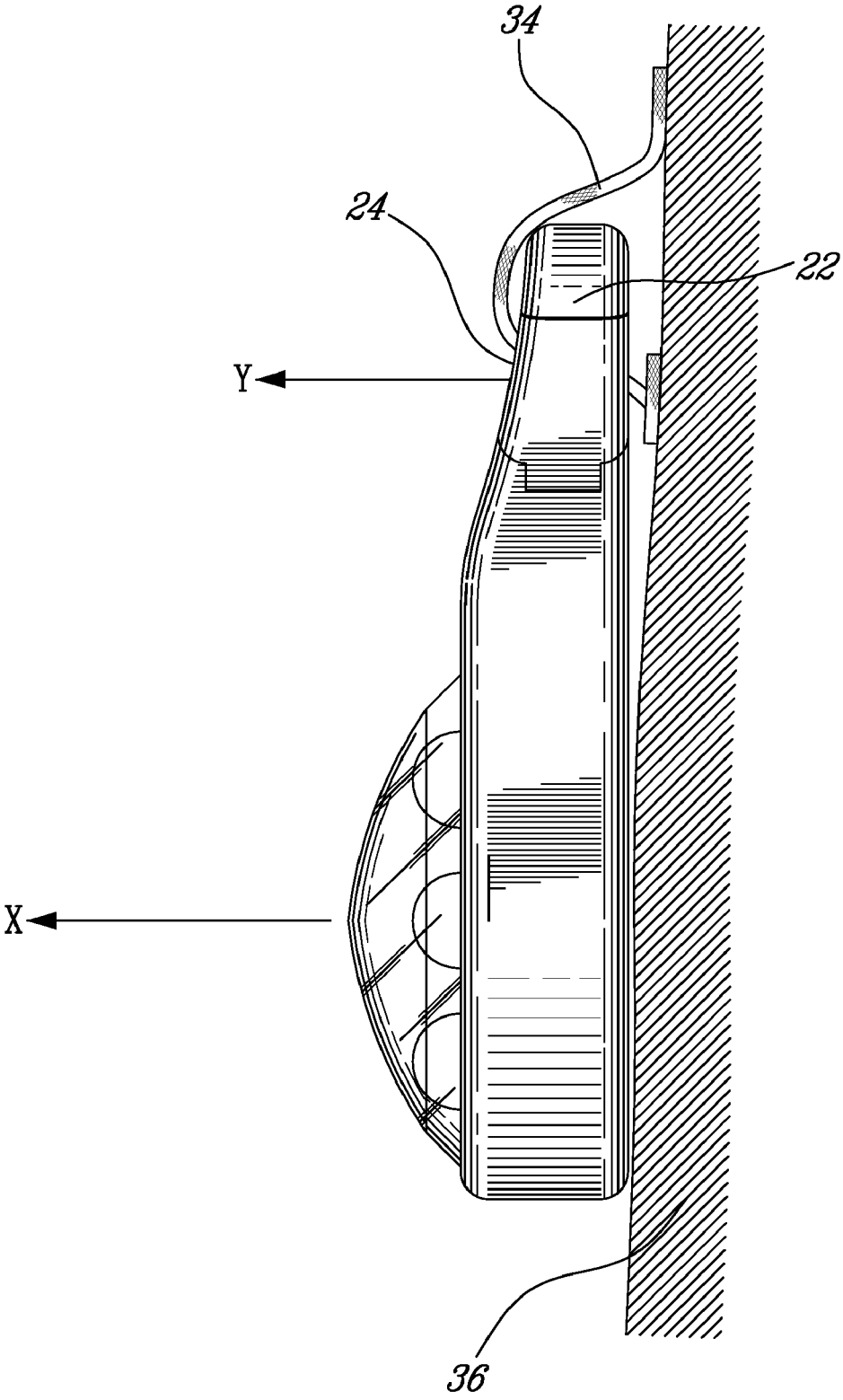
FIG. 3 is a side plan view of a portable light with clip in accordance with an illustrative embodiment of the present invention.

Referring now to FIG. 3, the hook portion 22 combined with the spring loaded clip 26 provides a means for quickly attaching and releasing the portable light 10 from a variety of objects, such as belt loops 34 and the like. Additionally, the light sources 14 are positioned to emit light generally normal to the flat body 12 along the indicated axis X which is substantially parallel to the indicated axis Y of the aperture 24. This means that, when the portable light 10 is suspended from a belt loop 34 or the like, light is emitted substantially at right angles away from the object as in 36 to which it is mounted, which provides for improved visibility in a number of applications. Note that although the emitted light is illustratively shown as being at right angles to the surface of the object as in 36 to which it is mounted, in an alternative embodiment a plurality of light sources 14 could be arranged generally about an axis at right angles to the object as in 36 but such that their emitted light is at a lesser angle.

Referring back to FIG. 1, as stated above, the series buttons as in 20 provide access to functions supported by electronics (not shown) encapsulated within the hollow body 12. These functions comprise, for example, different intensities for the light sources, different signalling patterns or signatures, etc..

It is to be understood that the invention is not limited in its application to the details of construction and parts illustrated in the accompanying drawings and described hereinabove. The invention is capable of other embodiments and of being practised in various ways. It is also to be understood that the phraseology or terminology used herein is for the purpose of description and not limitation. Hence, although the present invention has been described hereinabove by way of preferred embodiments thereof, it can be modified, without departing from the spirit, scope and nature of the subject invention as defined in the appended claims.

We claim:

1. A portable light comprising:

at least one light emitting diode;

a battery;

a switch operable for closing an electronic circuit between said battery and said light emitting diode, wherein when said electronic circuit is closed said at least one diode emits light generally about a first axis; and a body adapted to receive said light emitting diode, said battery and said switch, said body comprising an integrated karabiner like loop portion towards one end thereof defining a loop aperture having loop axis, said loop comprising a hook portion and a normally closed spring loaded clip providing access to said loop aperture;

wherein said loop axis remains substantially in parallel to said first axis regardless of an orientation of said body.

2. The portable light of claim 1, wherein said body includes a hollow portion for storing said at least one battery therein.

3. The portable light of claim 2, wherein said integrated loop portion can be removed from said hollow portion thereby allowing for replacement of said at least one battery.

4. The portable light of claim 1, further comprising a transparent lens covering said at least one light emitting diode.

* * * * *